US006883432B2

(12) United States Patent
Yamamoto et al.

(10) Patent No.: US 6,883,432 B2
(45) Date of Patent: Apr. 26, 2005

(54) INK FEEDING METHOD AND INK FEEDING APPARATUS FOR A PRINTING MACHINE

(75) Inventors: Takaharu Yamamoto, Kyoto (JP); Satoru Kiyohara, Kyoto (JP); Kunio Muraji, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/410,231

(22) Filed: Apr. 10, 2003

(65) Prior Publication Data

US 2003/0217659 A1 Nov. 27, 2003

(30) Foreign Application Priority Data

May 21, 2002 (JP) ..... 2002-145624

(51) Int. Cl.[7] ..... B41F 31/02

(52) U.S. Cl. ..... 101/484; 101/365; 101/DIG. 45; 101/DIG. 47

(58) Field of Search ..... 101/350.1, 365, 101/484, DIG. 45, DIG. 47

(56) References Cited

U.S. PATENT DOCUMENTS

| | | | | |
|---|---|---|---|---|
| 4,586,148 | A | 4/1986 | Rehder et al. | |
| 5,029,527 | A * | 7/1991 | Jeschke et al. | 101/365 |
| 5,070,784 | A | 12/1991 | Nishida et al. | |
| 5,122,977 | A * | 6/1992 | Pfeiffer | 101/211 |
| 5,835,626 | A * | 11/1998 | Huber et al. | 382/167 |
| 6,378,429 | B1 | 4/2002 | Tomita et al. | |
| 6,389,968 | B1 * | 5/2002 | Sugimoto et al. | 101/365 |
| 6,412,411 | B1 * | 7/2002 | Sugiyama et al. | 101/365 |
| 6,446,555 | B1 | 9/2002 | Schramm et al. | |
| 6,450,097 | B1 * | 9/2002 | Kistler et al. | 101/483 |
| 6,684,790 | B1 | 2/2004 | Bestmann et al. | |
| 2001/0020427 | A1 * | 9/2001 | Shiraishi | 101/365 |
| 2002/0043166 | A1 | 4/2002 | Okuda | |
| 2003/0217654 | A1 * | 11/2003 | Yamamoto et al. | 101/148 |
| 2003/0217658 | A1 * | 11/2003 | Yamamoto et al. | 101/350.1 |

FOREIGN PATENT DOCUMENTS

| | | |
|---|---|---|
| EP | 1 005 985 A2 | 6/2000 |
| EP | 1 136 266 | 9/2001 |
| EP | 1 136 268 A1 | 9/2001 |
| JP | 64-53845 | 3/1989 |
| JP | 11-198349 | 7/1999 |

* cited by examiner

*Primary Examiner*—Andrew H. Hirshfeld
*Assistant Examiner*—Leo T. Hinze
(74) *Attorney, Agent, or Firm*—McDermott Will & Emery LLP

(57) ABSTRACT

An ink feeding method for a printing machine includes a color density measuring step for measuring color density of prints at intervals of time, a variation coefficient computing step for computing a variation coefficient for varying the ink feeding rate based on the color density of prints and a target color density of prints, a color density gradient computing step for computing, based on the color density of prints, a color density gradient representing a rate of variation in the color density of prints occurring with an increase in the number of prints, an expected color density computing step for computing, based on the color density gradient, an expected color density of prints occurring after a predetermined number of prints are made, a determining step for determining whether the expected color density of prints occurring after the predetermined number of prints are made exceeds the target color density of prints, and a variation coefficient correcting step for correcting the variation coefficient when the expected color density of prints is determined to exceed the target color density of prints.

20 Claims, 17 Drawing Sheets

FIG. 17

| pattern area rate | density gradient Vn | | | | | | |
|---|---|---|---|---|---|---|---|
| | steep rise | medium rise | gentle rise | level | gentle fall | medium fall | steep fall |
| min. | m01 | m02 | m03 | 1 | m04 | m05 | m06 |
| small | m07 | m08 | m09 | 1 | m10 | m11 | m12 |
| medium | m13 | m14 | m15 | 1 | m16 | m17 | m18 |
| large | m19 | m20 | m21 | 1 | m22 | m23 | m24 |
| max. | m25 | m26 | m27 | 1 | m28 | m29 | M30 |

INK FEEDING METHOD AND INK FEEDING APPARATUS FOR A PRINTING MACHINE

BACKGROUND OF THE INVENTION

1. Field of the Invention

This invention relates to an ink feeding method and ink feeding apparatus for a printing machine, for controlling an ink feeding rate by measuring color density of prints produced.

2. Description of the Related Art

Such a printing machine has an ink feeding apparatus for adjusting the rate of feeding ink to ink rollers. The ink feeding apparatus includes a plurality of ink keys juxtaposed in a direction perpendicular to a direction in which printing paper is transported in time of printing. The rate of feeding ink to the ink rollers is adjusted by varying the opening degree of each ink key. In this way, the rate of feeding ink ultimately to a printing plate is adjusted.

The printing plate has areas called detecting patches or control strips formed in positions corresponding to the respective ink keys. The color density of the detecting patches actually printed on the printing paper is measured with a densitometer to adjust the opening degree of each ink key.

When printing with such a printing machine, the color density of prints may not agree with a predetermined value immediately after start of a printing operation even though the ink keys in the ink feeding apparatus have a proper opening degree. In such a case, when the color density of prints is measured and the ink feeding rate is automatically controlled, the opening degree of the ink keys, even though proper, is further adjusted in an opening direction.

Since numerous ink rollers are used in such a printing machine, a predetermined time is taken until an adjustment of the opening degree of each ink key is reflected in the rate of feeding ink to printing paper. Thus, when the ink feeding rate is automatically controlled by measuring the color density of prints immediately after adjusting the opening degree of the ink keys, the opening degree of the ink keys is further adjusted even though the opening degree is proper.

The rate of feeding dampening water to the printing plate influences the rate of feeding ink to the printing plate. Thus, when the ink feeding rate is automatically controlled by measuring the color density of prints immediately after adjusting the rate of feeding dampening water to the printing plate, the opening degree of the ink keys is further adjusted even though the opening degree is proper.

An adjustment of the opening degree of the ink keys, therefore, is prohibited immediately after start of a printing operation, or after an adjustment is made of the ink or water feeding rate, until a predetermined number of sheets are printed or until lapse of a fixed time.

However, where a long time is set for the above prohibition, the ink feeding rate cannot be controlled quickly. This presents a problem of taking a long time before the color density of actual prints settles at a target value.

On the other hand, when the opening degree of the ink keys is varied excessively to control the ink feeding rate quickly, a gross overshooting will occur before the color density of prints settles at a target value.

SUMMARY OF THE INVENTION

The object of this invention, therefore, is to provide an ink feeding method and the ink feeding apparatus for a printing machine, for enabling the color density of prints to settle at a target value quickly without causing a gross overshooting.

The above object is fulfilled, according to this invention, by the ink feeding method set out below and an in feeding apparatus constructed for executing this method.

An ink feeding method for a printing machine for controlling an ink feeding rate by measuring color density of prints, in one aspect of the invention, comprises a color density measuring step for measuring color density of prints at intervals of time; a color density gradient computing step for computing, based on the color density of prints measured in the color density measuring step, a color density gradient representing a rate of variation in the color density of prints occurring with an increase in the number of prints; an expected color density computing step for computing, based on the color density gradient computed in the color density gradient computing step, an expected color density of prints occurring after a predetermined number of prints are made; and an ink feeding rate controlling step for controlling the ink feeding rate based on the expected color density of prints computed in the expected color density computing step and a target color density of prints.

With such ink feeding method and ink feeding apparatus for a printing machine, the color density of prints is measured at intervals of time for causing the color density of prints to attain a target value quickly. Thus, the gross overshooting noted hereinbefore may be prevented.

Preferably, the ink feeding rate controlling step is executed for controlling the ink feeding rate based on a difference between the expected color density of prints and the target color density of prints.

The color density measuring step may be executed for measuring the color density of prints at intervals of time by an image pickup unit arranged to pick up images of printed sheets of paper transported toward a paper discharge position.

In another aspect of the invention, an ink feeding method comprises a color density measuring step for measuring color density of prints at intervals of time; a variation coefficient computing step for computing a variation coefficient for varying the ink feeding rate, based on the color density of prints measured in the color density measuring step and a target color density of prints; a color density gradient computing step for computing, based on the color density of prints measured in the color density measuring step, a color density gradient representing a rate of variation in the color density of prints occurring with an increase in the number of prints; an expected color density computing step for computing, based on the color density gradient computed in the color density gradient computing step, an expected color density of prints occurring after a predetermined number of prints are made; a determining step for determining, based on the color density of prints measured in the color density measuring step and the target color density of prints, whether the expected color density of prints occurring after the predetermined number of prints are made exceeds the target color density of prints; a variation coefficient correcting step for correcting the variation coefficient computed in the variation coefficient computing step when the expected color density of prints is determined in the determining step to exceed the target color density of prints; and an ink feeding rate controlling step for controlling the ink feeding rate based on one of the variation coefficient computed in the variation coefficient computing step and the variation coefficient corrected in the variation coefficient correcting step.

Preferably, the variation coefficient correcting step is executed for correcting the variation coefficient computed in the variation coefficient computing step based on a value of at least one of the color density gradient computed in the color density gradient computing step and a pattern area rate of the prints.

The color density measuring step may be executed for measuring the color density of prints at intervals of time by an image pickup unit arranged to pick up images of printed sheets of paper transported toward a paper discharge position.

In a further aspect of the invention, an ink feeding method for a printing machine is provided for controlling an ink feeding rate at an initial printing stage by measuring color density of prints, the method comprising a color density measuring step for measuring color density of prints at intervals of time after printing a fixed number of printing sheets without varying the ink feeding rate after start of a printing operation; a color density gradient computing step for computing, based on the color density of prints measured in the color density measuring step, a color density gradient representing a rate of variation in the color density of prints occurring with an increase in the number of prints; an expected color density computing step for computing, based on the color density gradient computed in the color density gradient computing step, an expected color density of prints occurring after a predetermined number of prints are made; and an ink feeding rate controlling step for controlling the ink feeding rate based on the expected color density of prints computed in the expected color density computing step and a target color density of prints.

Other features and advantages of the present invention will be apparent from the following detailed description of the embodiments of the invention.

BRIEF DESCRIPTION OF THE DRAWINGS

This invention may be embodied in other specific forms without departing from the spirit or essential attributes thereof and, accordingly, reference should be made to the appended claims, rather than to the foregoing specification, as indicating the scope of the invention.

FIG. 17 is an explanatory view of a look-up table storing gradient correction factors.

DESCRIPTION OF THE PREFERRED EMBODIMENTS

An embodiment of the invention will be described hereinafter with reference to the drawings.

Figure 1:
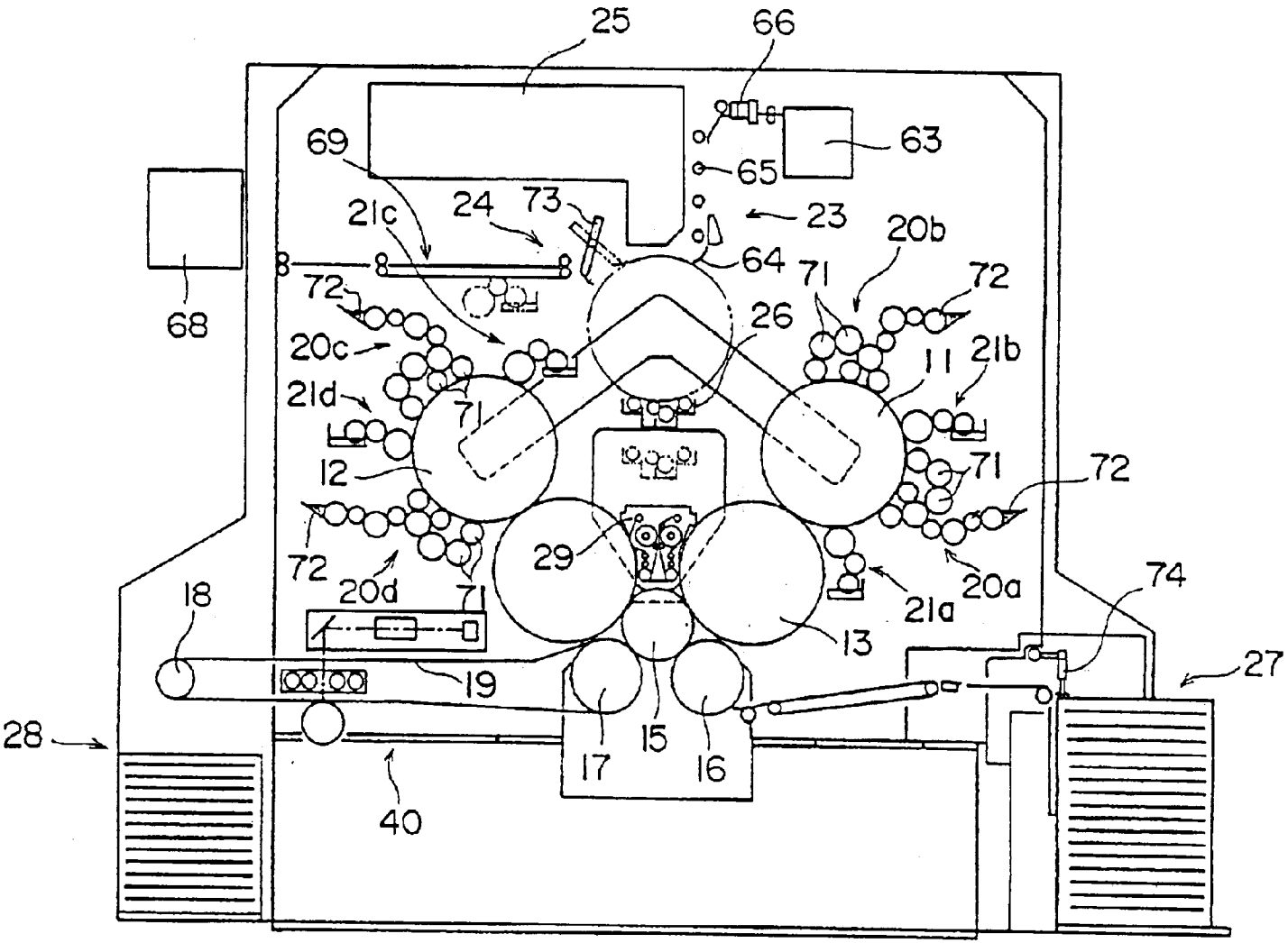
FIG. 1 is a schematic side view of a printing machine according to this invention.

FIG. 1 is a schematic side view of a printing machine according to the invention.

This printing machine records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The machine further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, an image pickup station 40 for measuring color densities of detecting patches printed on the printing paper, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is driven by a motor not shown to rotate synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of grippers, not shown, for gripping the forward and rear ends of the plate fed from the plate feeder 23.

The plate remover 24 has a pawl mechanism 73 for separating a plate from the first or second plate cylinder 11 or 12 after a printing operation, a discharge cassette 68, and a conveyor mechanism 69 for transporting the plate separated by the pawl mechanism 73 to the discharge cassette 68.

The forward end of the plate drawn from the feeder cassette 63 is guided by the guide rollers 65 and guide member 64, and gripped by one of the grippers on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is gripped by the other gripper. While, in this state, the first or second plate cylinder 11 or 12 is rotated at low speed, the image recorder 25 irradiates the surface of the plate mounted peripherally of the first or second plate cylinder 11 or 12 with a modulated laser beam for recording images thereon.

Figure 2A:
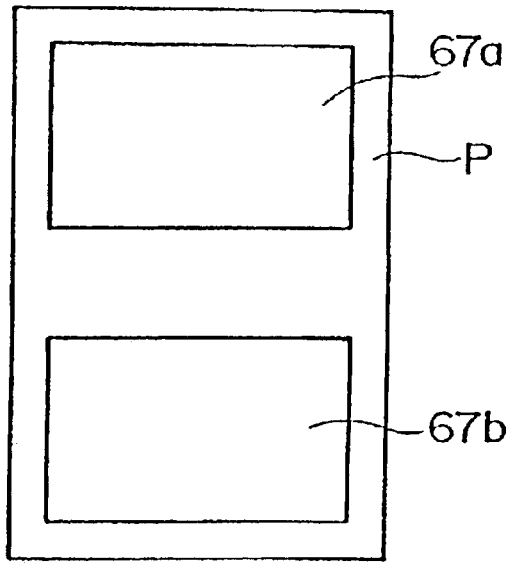
FIG. 2A is a plan view showing an arrangement of image areas, one for printing in black ink and the other for printing in magenta ink, on a printing plate mounted peripherally of a first plate cylinder.
Figure 2B:
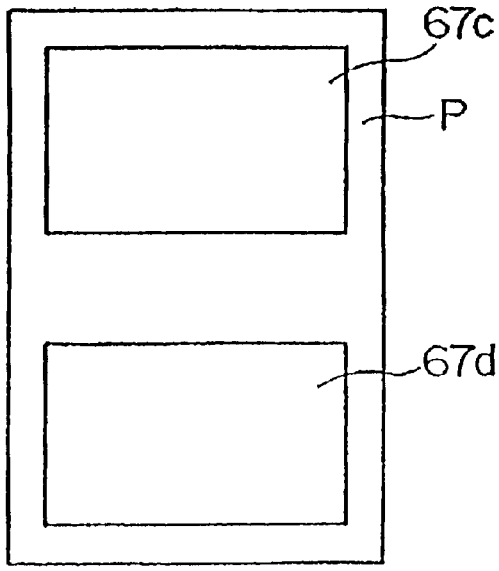
FIG. 2B is a plan view showing an arrangement of image areas, one for printing in cyan ink and the other for printing in yellow ink, on a printing plate mounted peripherally of a second plate cylinder.

On the plate P mounted peripherally of the first plate cylinder 11, the image recorder 25, as shown in FIG. 2A, records an image area 67*a* to be printed with black ink, and an image area 67*b* to be printed with magenta ink. On the plate P mounted peripherally of the second plate cylinder 12, the image recorder 25, as shown in FIG. 2B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an ink source 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

Figure 3:
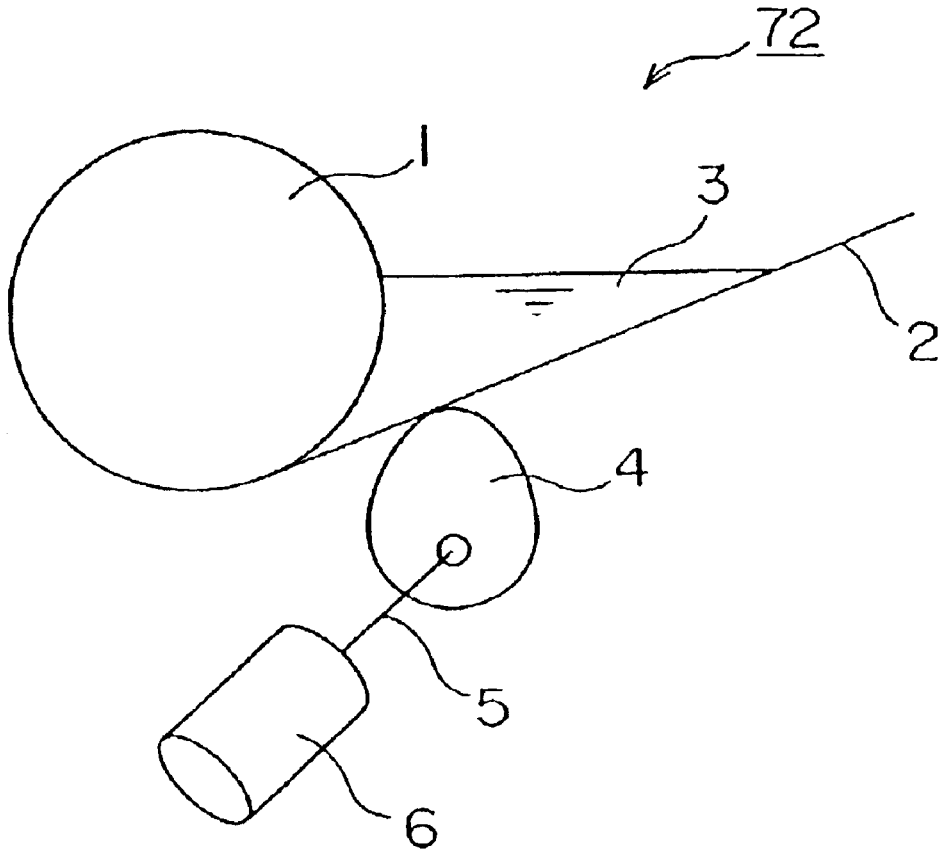
FIG. 3 is a schematic side view of an ink source.
Figure 4:
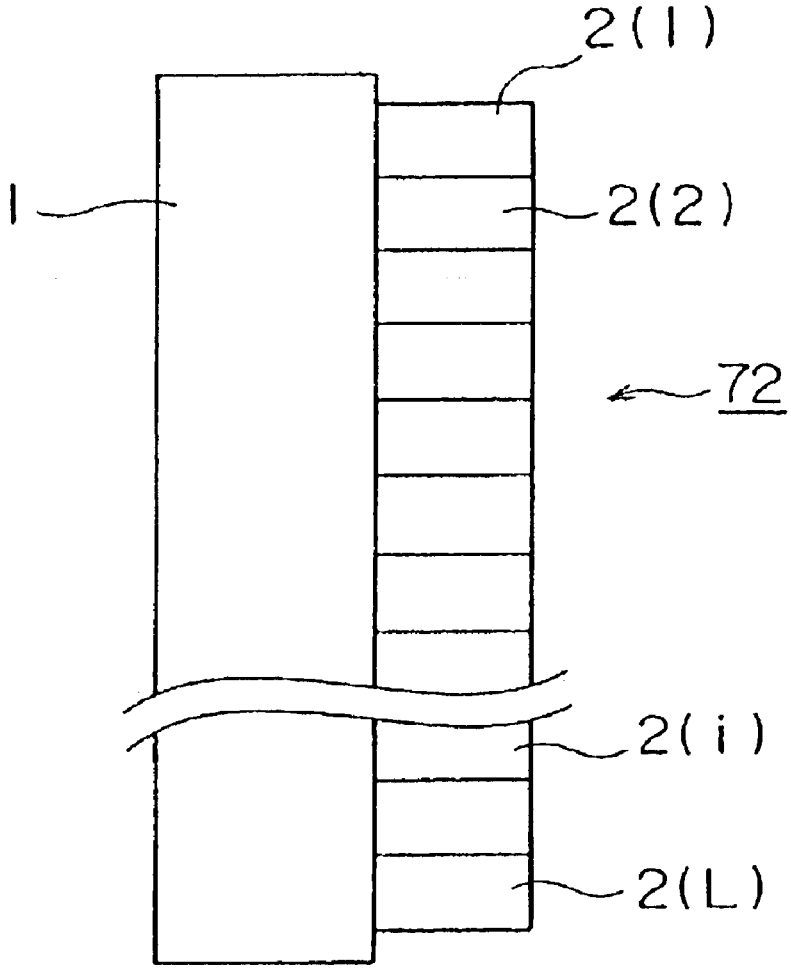
FIG. 4 is a plan view of the ink source.

FIG. 3 is a schematic side view of the ink source 72 noted above. FIG. 4 is a plan view thereof. Ink 3 is omitted from FIG. 4.

The ink source 72 includes an ink fountain roller 1 having an axis thereof extending in a direction of width of printed matter (i.e. perpendicular to a printing direction of the printing machine), and ink keys 2 (1), 2 (2) . . . 2 (L) arranged in the direction of width of the printed matter. In this specification, these ink keys may be collectively called "ink keys 2". The ink keys 2 correspond in number to the number L of areas divided in the direction of width of the printed matter. Each of the ink keys 2 has an adjustable opening degree with respect to the outer periphery of the ink fountain roller 1. The ink fountain roller 1 and ink keys 2 define an ink well for storing ink 3.

Eccentric cams 4, L in number, are arranged under the respective ink keys 2 for pressing the ink keys 2 toward the surface of ink fountain roller 1 to vary the opening degree of each ink key 2 with respect to the ink fountain roller 1. The eccentric cams 4 are connected through shafts 5 to pulse motors 6, L in number, for rotating the eccentric cams 4, respectively.

Each pulse motor 6, in response to an ink key drive pulse applied thereto, rotates the eccentric cam 4 about the shaft 5 to vary a pressure applied to the ink key 2. The opening degree of the ink key 2 with respect to the ink fountain roller 1 is thereby varied to vary the rate of ink fed to the printing plate.

Referring again to FIG. 1, the dampening water feeders 21*a*, 21*b*, 21*c* and 21*d* (which may be referred to collectively as "dampening water feeders 21") feed dampening water to the plates P before the ink feeders 20 feed the inks thereto. Of the dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

Figure 5:
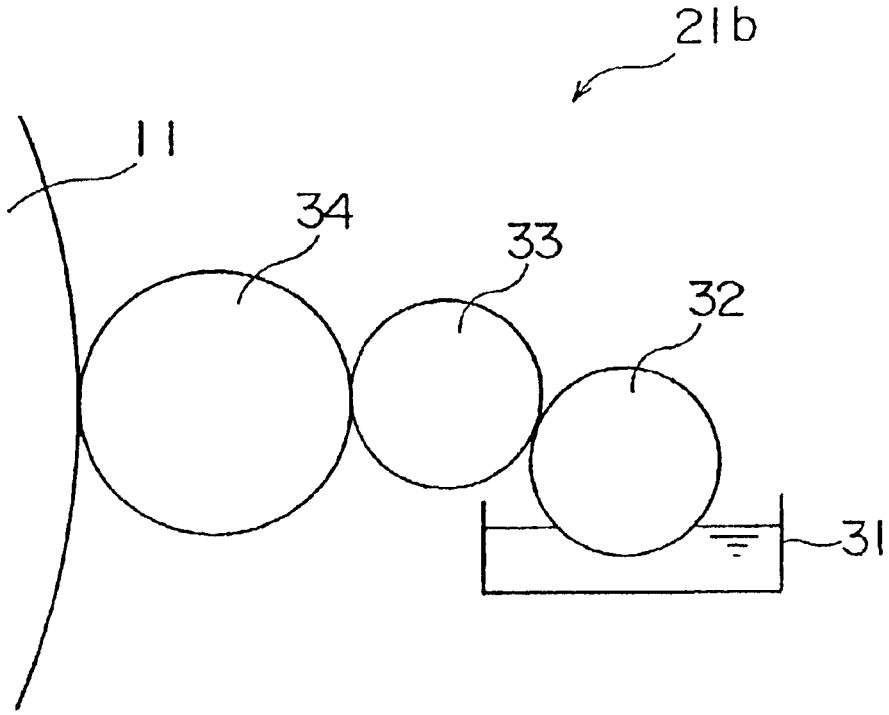
FIG. 5 is a schematic side view of a dampening water feeder.

FIG. 5 is a schematic side view of the dampening water feeder 21*b*.

The dampening water feeder 21*b* includes a water source having a water vessel 31 for storing dampening water and a water fountain roller 32 rotatable by a motor, not shown, and two water rollers 33 and 34 for transferring dampening water from the fountain roller 32 to the surface of the plate mounted peripherally of the first plate cylinder 11. This dampening water feeder is capable of adjusting the rate of feeding dampening water to the surface of the plate by varying the rotating rate of fountain roller 32.

The three other water feeders 21*a*, 21*c* and 21*d* have the same construction as the water feeder 21*b*.

Referring again to FIG. 1, the developing device 26 is disposed under the first plate cylinder 11 or second plate cylinder 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers 41 arranged thereon. When the impression cylinder 15 transfers the printing paper to the discharge cylinder 17, one of the grippers 41 of the discharge cylinder 17 holds the forward end of the printing paper having been held by the gripper of the impression cylinder 15. With movement of the chains 19, color densities of the detecting patches printed on the printing paper are measured at the image pickup station 40. Thereafter the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 6:
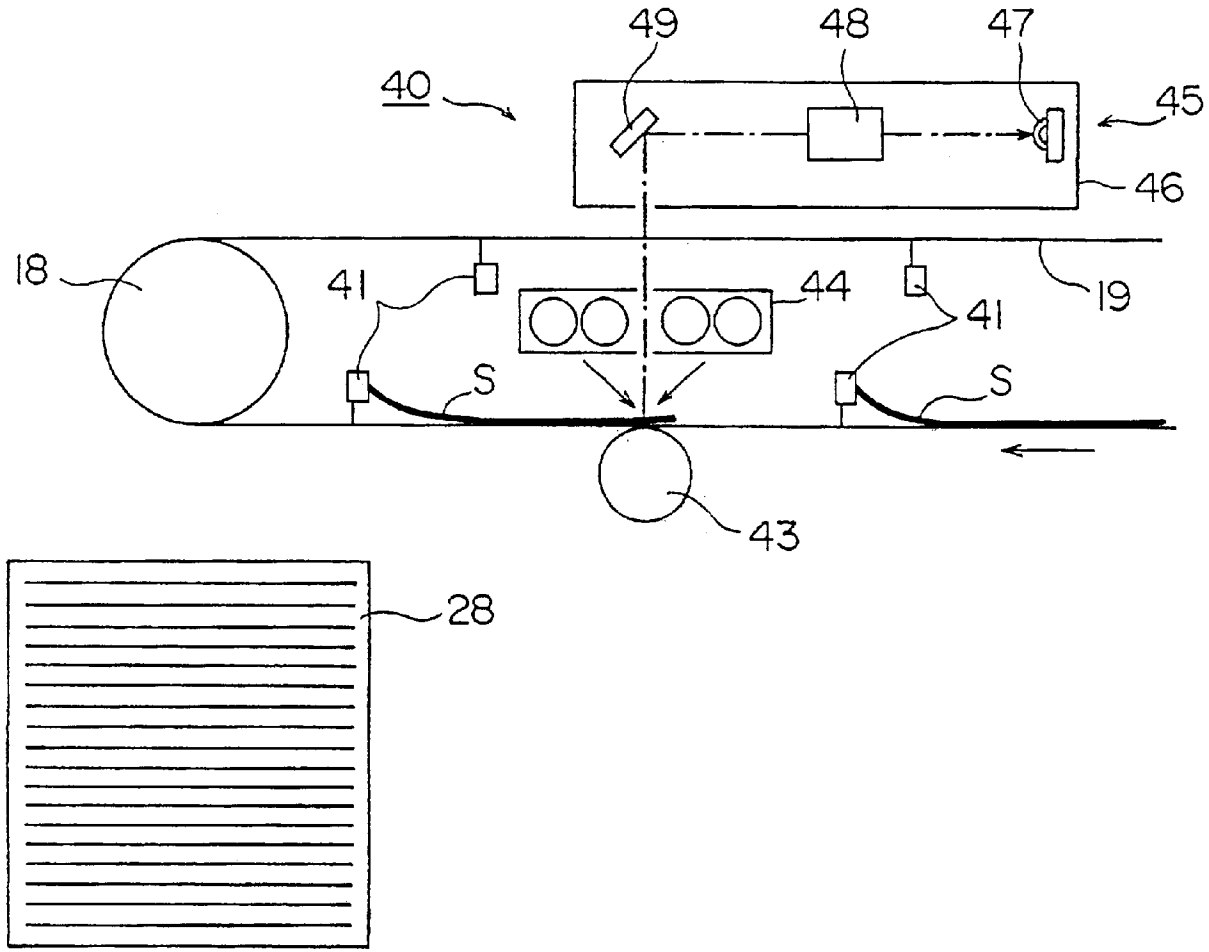
FIG. 6 is a schematic side view of an image pickup station shown with chains.

FIG. 6 is a schematic side view of the image pickup station 40 for measuring color densities of the detecting patches printed on the printing paper, which is shown with the chains 19.

The pair of chains 19 are endlessly wound around the opposite ends of the paper discharge cylinder 17 shown in FIG. 1 and a pair of large sprockets 18. As noted hereinbefore, the chains 19 are interconnected by coupling members, not shown, having a plurality of grippers 41 arranged thereon each for gripping a forward end of printing paper S transported.

The pair of chains 19 have a length corresponding to a multiple of the circumference of paper discharge cylinder 17. The grippers 41 are arranged on the chains 19 at intervals each corresponding to the circumference of paper discharge cylinder 17. Each gripper 41 is opened and closed by a cam mechanism, not shown, synchronously with the gripper on the paper discharge cylinder 17. Thus, each gripper 41 receives printing paper S from the paper discharge cylinder 17, transports the printing paper S with rotation of the chains 19, and discharges the paper S to the paper discharge station 28.

The printing paper S is transported with only the forward end thereof held by one of the grippers 41, the rear end of printing paper S not being fixed. Consequently, the printing paper S could flap during transport, which impairs an operation, to be described hereinafter, of the image pickup station 40 to measure densities of the detecting patches. To avoid such an inconvenience, this printing machine provides a suction roller 43 disposed upstream of the paper discharge station 28 for stabilizing the printing paper S transported.

The suction roller 43 is in the form of a hollow roller having a surface defining minute suction bores, with the hollow interior thereof connected to a vacuum pump not shown. The suction roller 43 is disposed to have an axis thereof extending parallel to the grippers 41 bridging the pair of chains 19, a top portion of the suction roller 43 being substantially at the same height as a lower run of the chains 19.

The suction roller 43 is driven to rotate or freely rotatable in a matching relationship with a moving speed of the grippers 41. Thus, the printing paper S is drawn to the surface of the suction roller 43, thereby being held against flapping when passing over the suction roller 43. In place of the suction roller 43, a suction plate may be used to suck the printing paper S two-dimensionally.

The image pickup station 40 includes an illuminating unit 44 for illuminating the printing paper S transported, and an image pickup unit 45 for picking up images of the detecting patches on the printing paper S illuminated by the illuminating unit 44 and measuring color densities of the patches. The illuminating unit 44 is disposed between the upper and lower runs of chains 19 to extend along the suction roller 43, and has a plurality of linear light sources for illuminating the printing paper S over the suction roller 43.

The image pickup unit 45 includes a light-shielding and dustproof case 46, and a mirror 49, a lens 48 and a CCD line sensor 47 arranged inside the case 46. The image pickup unit 45 picks up the image of printing paper S over the suction roller 43 through slits of the illuminating unit 44. Incident light of the image reflected by the mirror 49 passes through the lens 48 to be received by the CCD line sensor 47.

Figure 7:
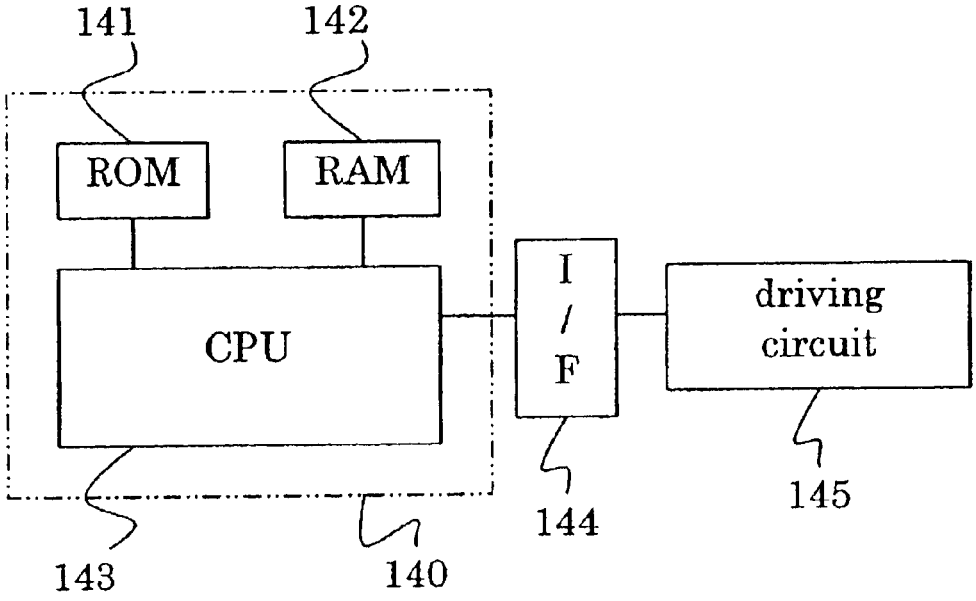
FIG. 7 is a block diagram of a principal electrical structure of the printing machine.

FIG. 7 is a block diagram showing a principal electrical structure of the printing machine. This printing machine includes a control unit 140 having a ROM 141 for storing operating programs necessary for controlling the machine, a RAM 142 for temporarily storing data and the like during a control operation, and a CPU 143 for performing logic operations. The control unit 140 has a driving circuit 145 connected thereto through an interface 144, for generating driving signals for driving the ink feeders 20, dampening water feeders 21, image recorder 25, developing device 26, blanket cleaning unit 29, image pickup station 40, the contact mechanisms for the first and second blanket cylinders 13 and 14, and so on. The printing machine is controlled by the control unit 140 to execute prepress and printing operations as described hereinafter.

Figure 8:
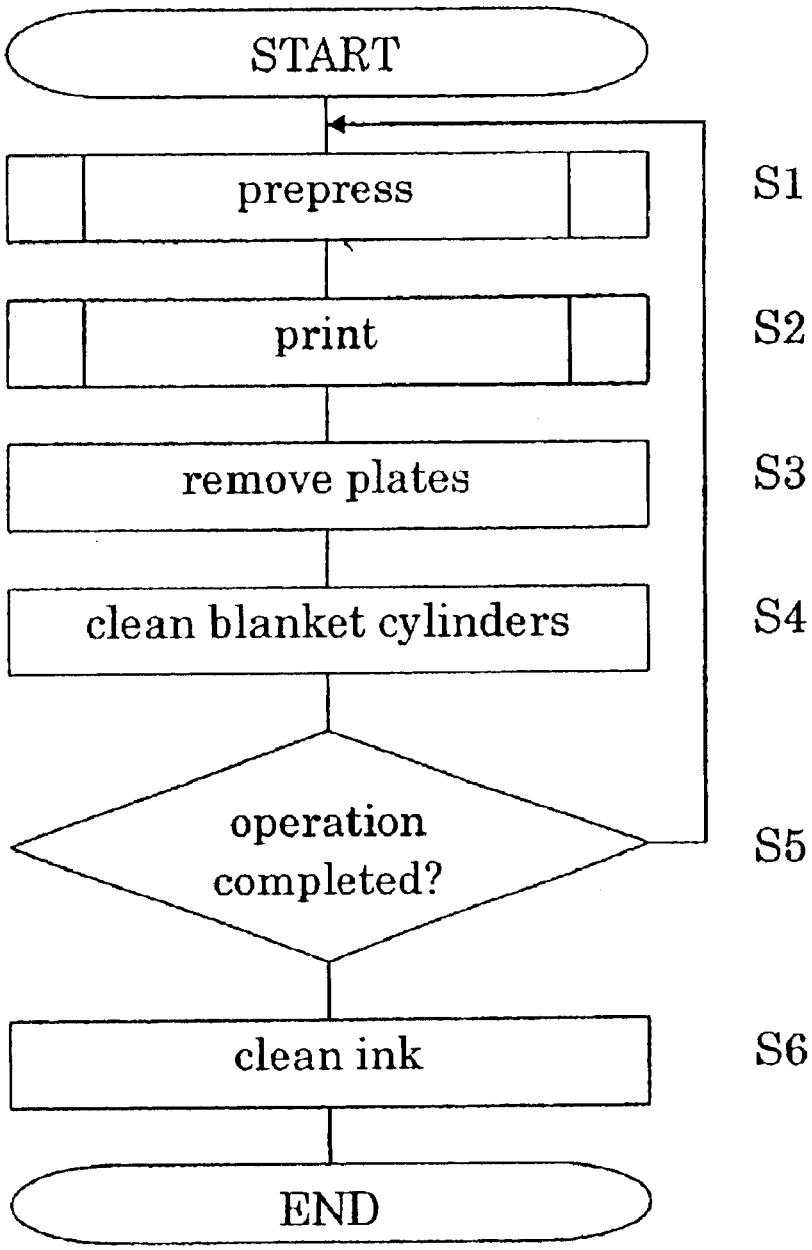
FIG. 8 is a flow chart of prepress and printing operations of the printing machine.

The prepress and printing operations of the printing machine will be described next. FIG. 8 is a flow chart showing an outline of the prepress and printing operations of the printing machine. These prepress and printing operations are directed to multicolor printing of printing paper S with the four color inks of yellow, magenta, cyan and black.

Figure 9:
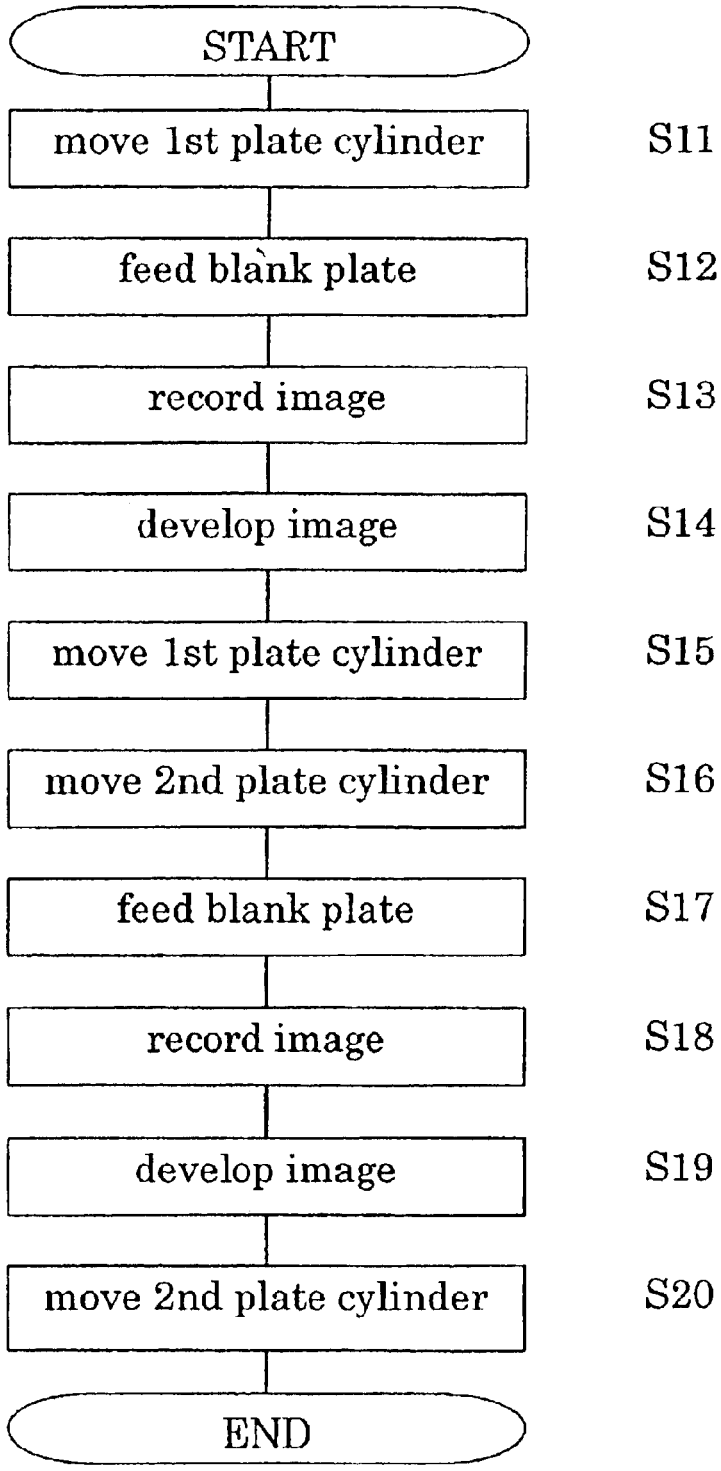
FIG. 9 is a flow chart of a prepress process.

First, the printing machine executes a prepress process for recording and developing images on the plates P mounted on the first and second plate cylinders 11 and 12 (step S1). This prepress process follows the steps constituting a subroutine as shown in the flow chart of FIG. 9.

The first plate cylinder 11 is first moved to the image recording position shown in the two-dot chain line in FIG. 1(step S11).

Next, a plate P is fed to the outer periphery of the first plate cylinder 11 (step S12). To achieve the feeding of the plate P, the pair of grippers, not shown, grip the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the printing machine carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 8, the prepress process is followed by a printing process for printing the printing paper S with the plates P mounted on the first and second plate cylinders 11 and 12 (step S2). This printing process is carried out as follows.

First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding water feeders 21 and ink feeders 20, respectively. These inks are transferred from the plates P to the corresponding regions of the first and second blanket cylinders 13 and 14, respectively.

Then, the printing paper S is fed to the paper feed cylinder 16. The printing paper S is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper S wrapped around the impression cylinder 15 in its first rotation, and the magenta and yellow inks in its second rotation.

The forward end of the printing paper S printed in the four colors is passed from the impression cylinder 15 to the paper discharge cylinder 17. This printing paper S is transported by the pair of chains 19 toward the paper discharge station 28. After the color densities of the detecting patches are measured at the image pickup station 40, the printing paper S is discharged to the paper discharge station 28.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the pawl mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the printing machine determines whether or not a further image is to be printed (step S5). If a further printing operation is required, the machine repeats steps S1 to S4.

If the printing operation is ended, the printing machine cleans the inks (step S6). For cleaning the inks, an ink cleaning device, not shown, provided for each ink feeder 20 removes the ink adhering to the ink rollers 71 and ink source 72 of each ink feeder 20.

With completion of the ink cleaning step, the printing machine ends the entire process.

The printing machine having the above construction uses detecting patches also known as control scales to control the rates of feeding ink to the printing plates P.

Figure 10:
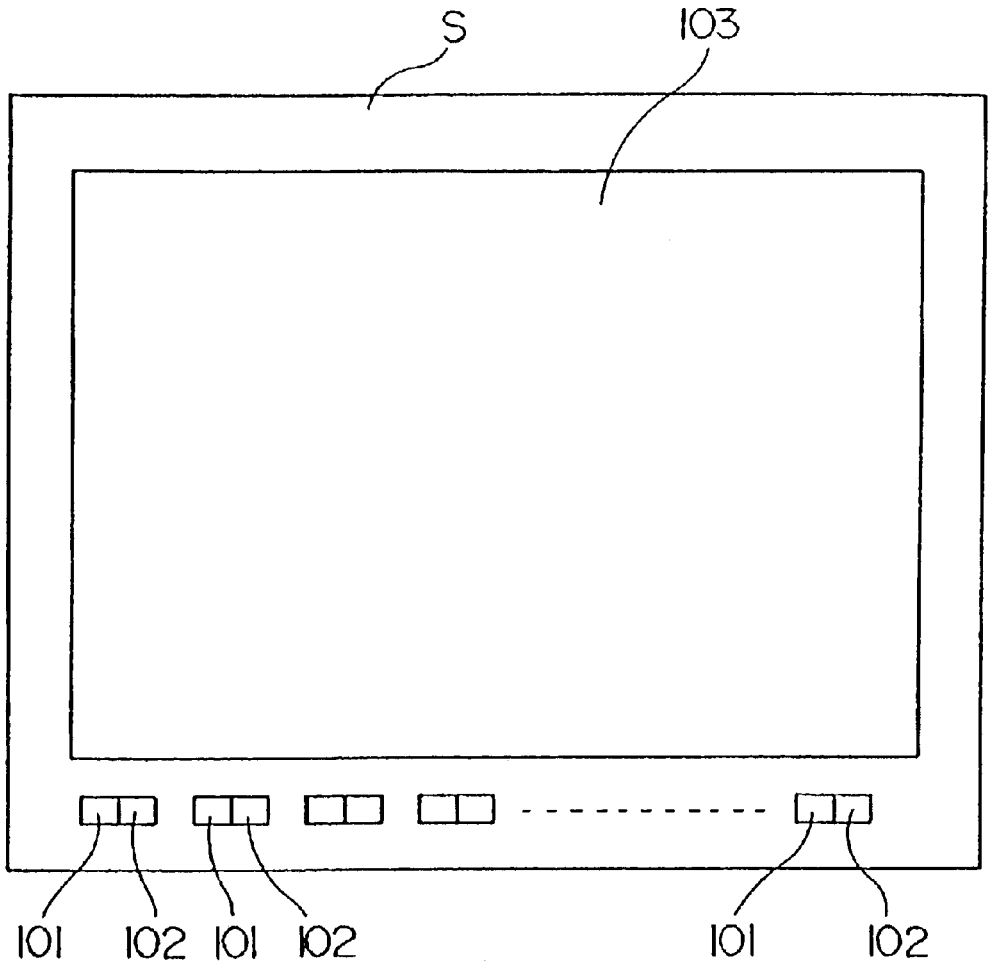
FIG. 10 is an explanatory view of first detecting patches and second detecting patches.

FIG. 10 is an explanatory view showing first detecting patches (first control strips) 101 and second detecting patches (second control strips) 102 printed on printing paper S after a printing process.

These first and second detecting patches 101 and 102 are printed in areas between one end of the printing paper S and an end of an image area 103 on the printing paper S. The first detecting patches 101 and second detecting patches 102 are arranged in discrete, adjacent pairs, L in number corresponding to the number L of areas divided in the direction of width of the printed matter (i.e. perpendicular to the printing direction of the printing machine), as are the ink keys 2 noted above. The material used for the first detecting patches 101 has a large halftone area ratio, or solid patches are used, while the material used for the second detecting patches 102 has a small halftone area ratio.

An operation for controlling the ink feeding rates in the above printing process (step S2) will be described next.

Figure 11:
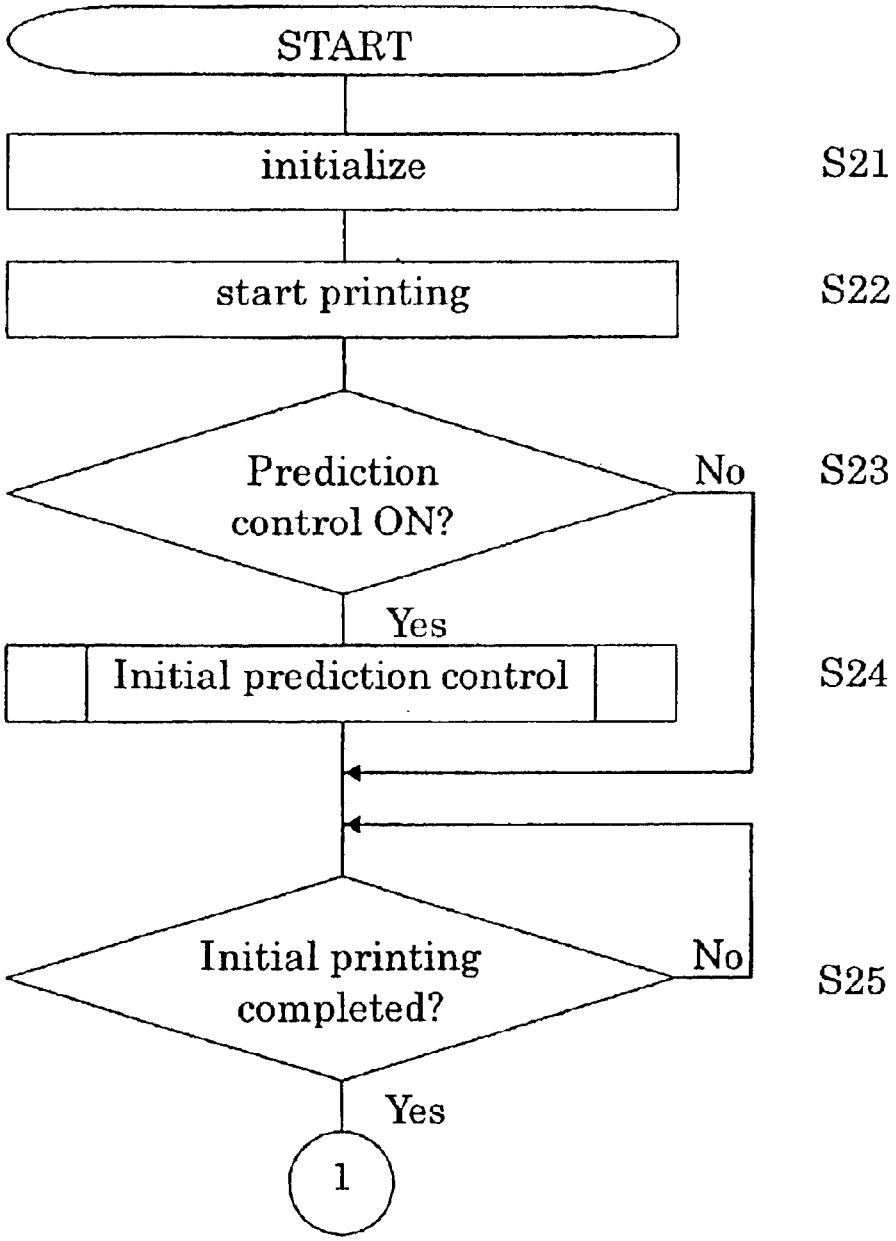
FIG. 11 is a flow chart of an overall ink feeding operation in a printing process.
Figure 12:
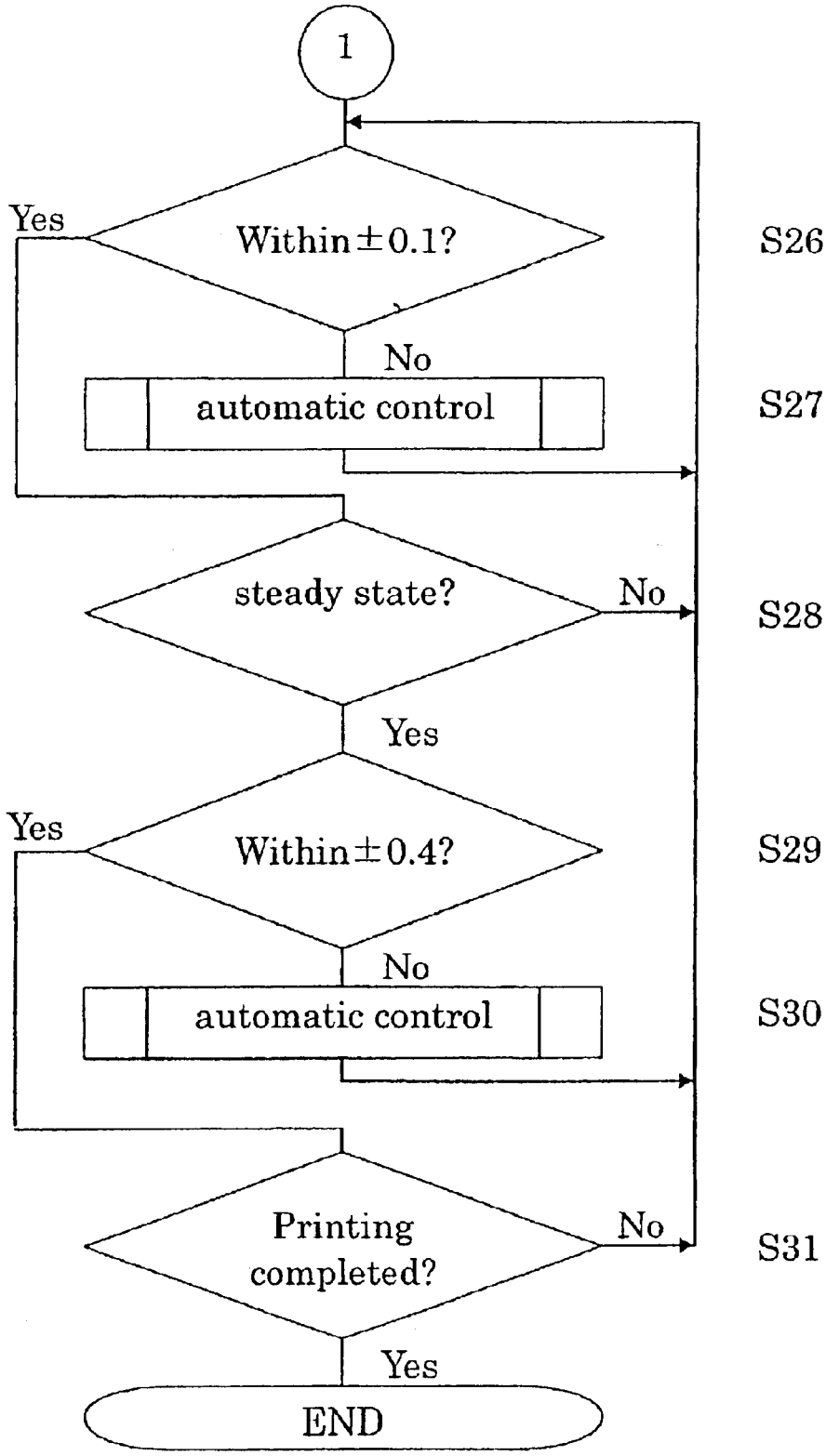
FIG. 12 is a flow chart of the overall ink feeding operation in the printing process.

An overall ink feeding operation in the printing process will be described first. FIGS. 11 and 12 are a flow chart showing the overall ink feeding operation in the printing process.

An initialization is carried out before a printing operation (step S21). In the initialization, the pulse motor 6 shown in FIG. 3 is driven to set the opening degree of each ink key 2 to an initial value based on a pattern area rate according to the L areas.

After the initialization, a printing operation is started (step S22). After starting the printing operation, the image pickup station 40 shown in FIG. 6 detects the color density of the first detecting patches 101 or second detecting patches 102 actually printed on printing paper S. The color density may be detected from all sheets of printing paper S, or every five printed sheets of printing paper S, for example. The color density may be measured by using either the first or second detecting patches 101 or 102. In the following description, only the first detecting patches 101 are used.

After starting the printing operation, the opening degree of each ink key 2 is not adjusted until about 100 sheets of printing paper S are printed. However, if an initial prediction control function is ON (step S23), an initial prediction control is performed as a subroutine (step S24). The initial prediction control is performed according to the flow chart shown in FIG. 13. The initial prediction control will be described in detail hereinafter.

When the initial prediction control is performed or the initial prediction control function is OFF, the machine determines whether or not an initial printing process for printing about 100 sheets of printing paper S has been completed (step S25).

After completion of the initial printing process, an automatic control is performed for automatically adjusting the opening degree of each ink key 2. This automatic control is performed only when an error in color density exceeds 0.1 before the printing attains a steady state, and only when an error in color density exceeds 0.04 after the printing attains the steady state.

That is, when an error in color density of the first detecting patches 101 actually printed on the printing paper S exceeds 0.1 after the initial printing process (step S26), the automatic control is performed as a subroutine (step S27). This automatic control is performed according to the flow chart shown in FIG. 15. The automatic control will be described in detail hereinafter.

When an error in color density of the first detecting patches 101 printed on the printing paper S is 0.1 or less (step S26), the machine determines whether the printing is in the steady state or not (step S28). Whether in the steady state or not is determined by checking whether the color density of the first detecting patches 101 actually printed on the printing paper S is continuously steady throughout about 30 sheets.

Only when the error in color density of the first detecting patches 101 actually printed on the printing paper S exceeds 0.04 after the steady state is attained (step S29), the automatic control is performed as a subroutine (step S30). When an error in color density of the first detecting patches 101 actually printed on the printing paper S is 0.04 or less, the above operation is repeated until required prints are made (step S31). This completes the printing process.

Figure 13:
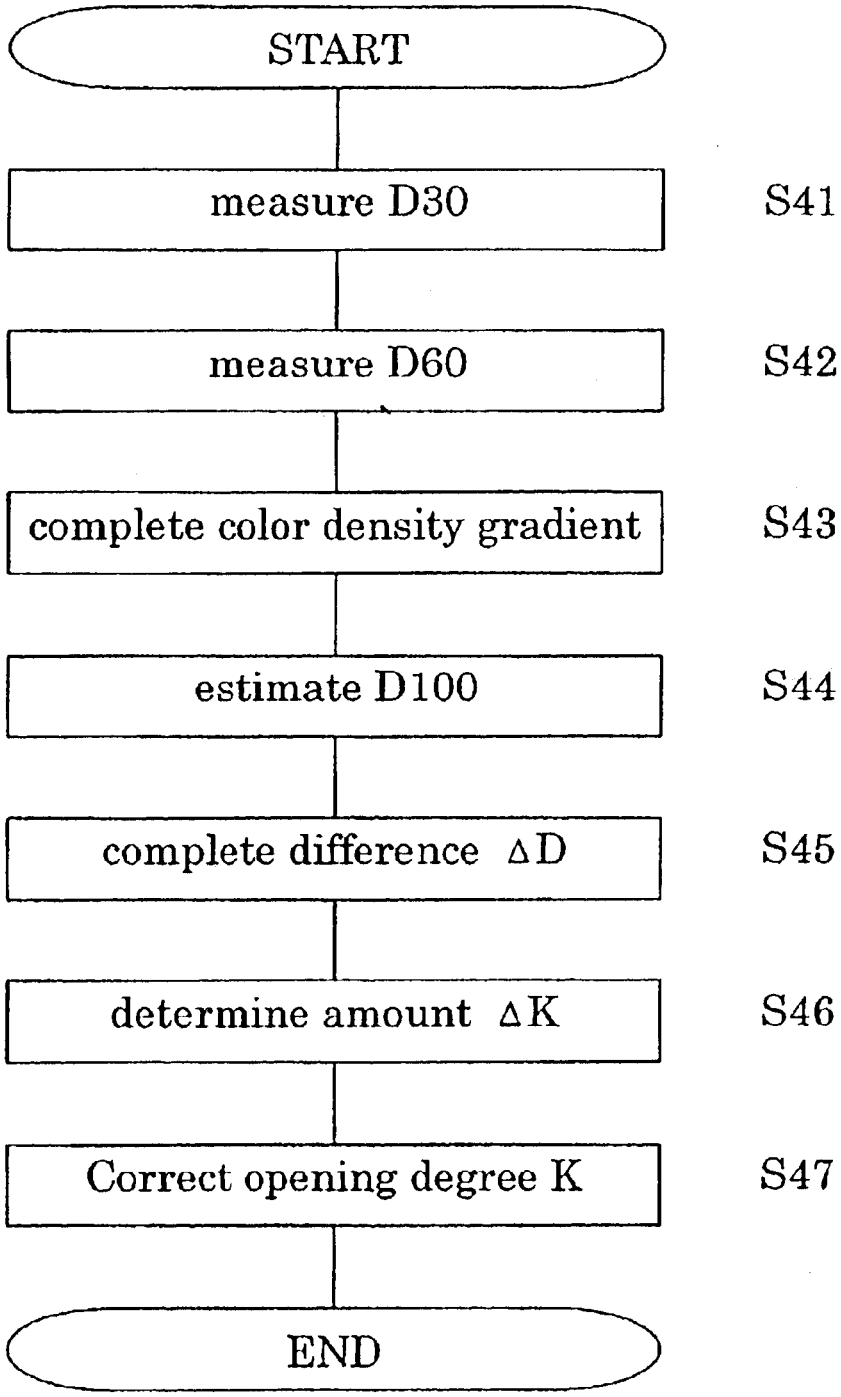
FIG. 13 is a flow chart of an initial prediction control process.
Figure 14:
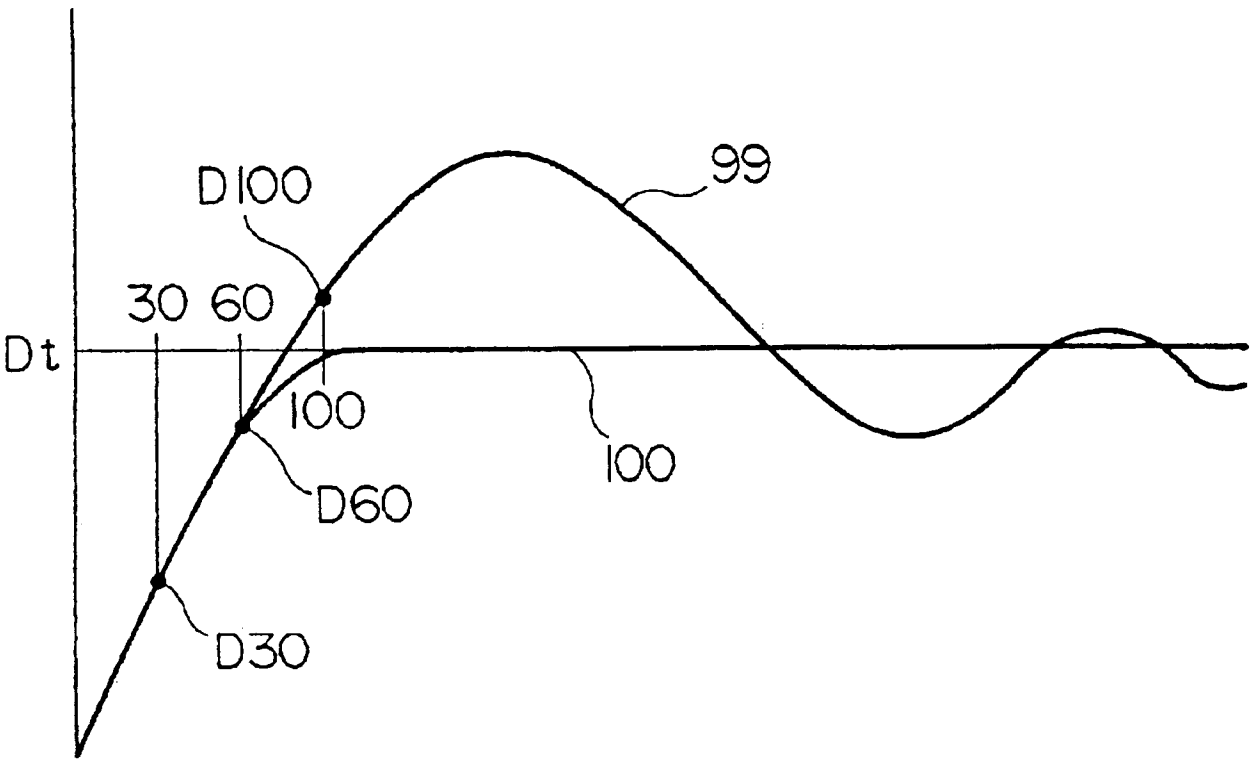
FIG. 14 is an explanatory view showing variations with time of color density of the first detecting patches actually printed on printing paper in the initial prediction process.

The initial prediction control process noted above will be described next. FIG. 13 is a flow chart which showing the initial prediction control process. FIG. 14 is an explanatory view showing variations with time in the color density of the first detecting patches 101 actually printed on the printing paper S in the initial prediction process. In FIG. 14, the vertical axis represents color density while the horizontal axis represents the number of prints.

In the initial prediction process, color density D30 of the first detecting patches 101 printed on the 30th sheet of printing paper S is measured first (step S41). Then, color density D60 of the first detecting patches 101 printed on the 60th sheet of printing paper S is measured (step S42). The color densities D30 and D60 are used to compute a color density gradient representing variations with time in the color density (step S43). Subsequently, color density D100 on the 100th sheet of printing paper S to be printed is estimated from the color density gradient (step S44).

Next, the estimated color density D100 and target color density Dt are compared, and a difference ΔD in color density is derived from the following equation (1) (step S45):

$$\Delta D = Dt - D100 \tag{1}$$

An amount of correction Δk of the opening degree of each ink key 2 is determined from the difference ΔD in color density (step S46). That is, the relationship between the amount of correction Δk of the opening degree of the keys and the difference ΔD in color density is determined from experiment beforehand. For example, the difference ΔD in color density is divided into several stages based on predetermined thresholds. The relationship between the values of the difference ΔD in color density and the amount of correction Δk of the opening degree of the keys is storied in a look-up table beforehand. The amount of correction Δk of the opening degree of the keys may be stored as a function of the difference ΔD in color density.

Subsequently, the opening degree K of each key 2 is corrected (step S47). Where the opening degree of each preceding ink key 2 is K0, the opening degree K1 of a next ink key 2 is derived from the following equation (2):

$$K1 = K0 + \Delta k \tag{2}$$

When no such initial prediction control is performed, an overshoot in color density occurs as at 99 in FIG. 14. However, when the initial prediction control is performed as described above, the color density of the first detecting patches 101 printed on the printing paper S promptly settles at the target color density Dt as at 100 in FIG. 14.

In the above embodiment, the amount of correction Δk of the opening degree of each key is derived from the difference ΔD between estimated color density D100 and target color density Dt shown in the equation (1). Alternatively, a correction factor ks of the opening degree of each key may be derived from a ratio J between estimated color density D100 and target color density Dt shown in the following equation (3), to correct the opening degree K based on this correction factor ks:

$$J = Dt / D100 \tag{3}$$

In this case also, the relationship between correction factor ks of the opening degree of each key and ratio J in color density is determined from experiment beforehand.

In this case, where the opening degree of each preceding ink key 2 is K0, the opening degree K1 of a next ink key 2 is derived from the following equation (4):

$$K1=K0\cdot ks \tag{4}$$

Figure 15:
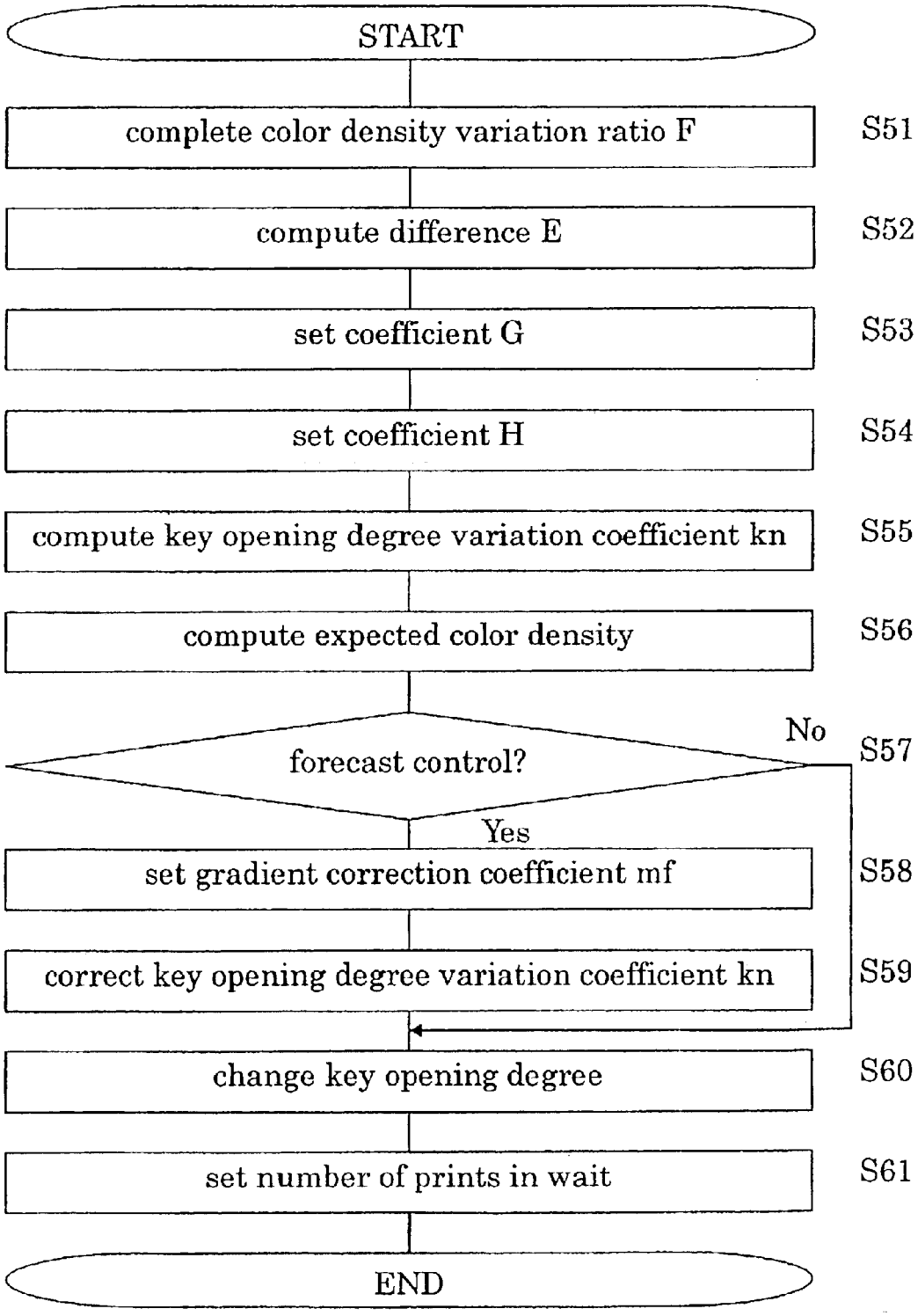
FIG. 15 is a flow chart of an automatic control process.

The automatic control process noted hereinbefore will be described next. FIG. 15 is a flow chart showing the automatic control process.

As noted hereinbefore, the automatic control process is performed only when an error in color density exceeds 0.1 before the printing attains the steady state, and only when an error in color density exceeds 0.04 after the printing attains the steady state. In the following description, the printing is assumed to have attained the steady state. The same process is performed also before the printing attains the steady state.

When the error in color density of the first detecting patches 101 actually printed on the printing paper S exceeds 0.04, a color density variation ratio F is derived from equation (5) below (step S51). When this density variation ratio F is larger than 1, the opening degree of each ink key 2 is increased. When the color density variation ratio F is smaller than 1, the opening degree of each ink key 2 is decreased. Dn in the following equation (5) represents the color density of the first detecting patches 101 actually printed on a current sheet of printing paper S.

$$F=Dt/Dn \tag{5}$$

This color density variation ratio F is converted into an ink key opening degree variation coefficient kn by using the following equation (6):

$$kn=H\cdot G\cdot(F-1)+1 \tag{6}$$

where H and G are coefficients established by operations described hereinafter.

Next, a difference E between the current color density Dn and target color density Dt is derived from the following equation (7) (step S52). The value of difference E is used in determining the coefficient G.

$$E=Dt-Dn \tag{7}$$

Then, the coefficient G in equation (6) is set based on the value of difference E derived from equation (7) above (step S53).

Specifically, when difference E is 0.4 or more, a relatively large positive value is set as coefficient G. When difference E is 0.15 or more and less than 0.4, a positive value of medium quantity is set as coefficient G. When difference E is 0.04 or more and less than 0.15, a relatively small positive value is set as coefficient G. When difference E is −0.15 or more and less than −0.04, a relatively small negative value is set as coefficient G. When difference E is −0.4 or more and less than −0.15, a negative value of medium quantity is set as coefficient G. When difference E is less than −0.4, a relatively large negative value is set as coefficient G. When difference E is −0.04 or more and less than 0.04, there is no need to change the opening degree of each ink key 2, and the key opening degree variation coefficient kn is regarded as 1. This coefficient G may be varied for each color ink, or may be used commonly for all the color inks.

Next, the coefficient H in equation (6) above is established (step S54). This coefficient H is determined from pattern area rates of a subject region. Specifically, the rate of pattern area is divided into five ranges of 0 to 10%, 10 to 20%, 20 to 40%, 40 to 60%, and 60 to 100%. For the higher pattern area rate, the larger value is set as coefficient H to enable control of the greater degree. This coefficient H also may be varied for each color ink, or may be used commonly for all the color inks.

Once the coefficient G and coefficient H have been determined in the above processes, the key opening degree variation coefficient kn is derived from equation (6) above (step S55).

When computing this key opening degree variation coefficient kn, an upper limit is provided for the color density variation ratio F to avoid an excessive rate of varying the amount of ink. For this purpose, the rate of pattern area in a subject region is divided into five ranges of 0 to 10%, 10 to 20%, 20 to 40%, 40 to 60%, and 60 to 100%, and the smaller upper limit is set to the color density variation ratio F for the higher pattern area rate. This is because, in a region with a large rate of pattern area, large variations occur with the ink feeding rate even when the color density variation ratio F is small.

When the upper limit of color density variation ratio F is set to 1.2, even if an actual color density variation ratio F derived from equation (5) is 1.4, for example, 1.2 is substituted for F in equation (6) to be solved. Instead of setting an upper limit to the color density variation ratio, an upper limit may be set to the key opening degree variation coefficient kn itself.

In an ordinary state, the opening degree of each ink key 2 is varied based on the key opening degree variation coefficient kn derived from the foregoing equation (6). However, an expected color density may be computed based on variations with time of measured color densities (step S56). When the result of this computation shows that an expected color density Df after printing a predetermined number of sheets Nf will exceed the target color density Dt, the following prediction control is performed.

Figure 16:
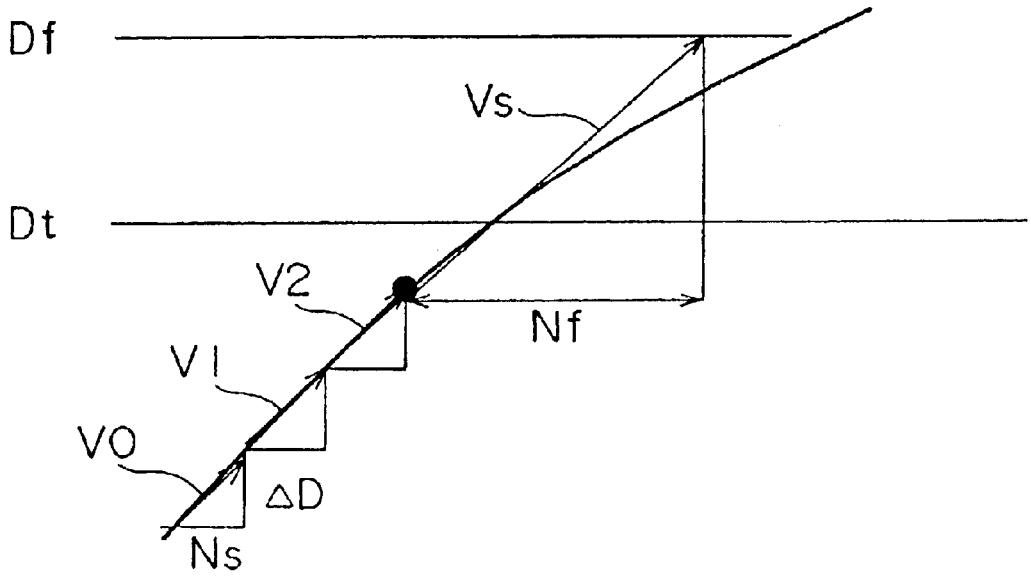
FIG. 16 is an explanatory view showing color density gradients.

Specifically, color density Dn is measured after printing every predetermined number of sheets Ns, e.g. five sheets. Density gradients V0, V1 and V2 for the past three variations are obtained from four latest measurements of color density as shown in FIG. 16. Each of these density gradients V0, V1 and V2 represents a value obtained by dividing a color density difference ΔD by the number of sheets Ns printed. Then, an average color density gradient Vs is derived from the following equation (8):

$$Vs=(V0+V1+V2)/3 \tag{8}$$

In the above equation (8), the average color density gradient Vs is obtained by simply averaging the density gradients V0, V1 and V2 for the past three variations. Instead, a computation may be carried out by weighting the density gradients V0, V1 and V2 for the past three variations. In this case, the heavier weight may be assigned to the later of the density gradients V0, V1 and V2 for the past three variations.

Subsequently, an expected color density Df after printing the predetermined number of sheets Nf is derived from the following equation (9) (step S56):

$$Df=Dn+Vs\cdot Nf \tag{9}$$

Next, whether a forecast control is required is determined (step S57). Specifically, when the target color density Dt exists between the current color density Dn and expected color density Df, the forecast control is performed on the grounds that, if the printing were continued, the color density Df after the printed number of sheets Nf would exceed the target density Dt. When the target color density Dt does not exist between the current color density Dn and expected color density Df, on the other hand, the opening degree of each ink key 2 is varied based on the key opening degree variation coefficient kn derived from the foregoing equation (6) without performing the forecast control.

When it is determined in step S57 that the forecast control is required, a gradient correction factor mf is set based on a current color density gradient Vn and the pattern area rate of a subject region. As shown in FIG. 17, the gradient correction factor mf is stored in a look-up table as having values varying from m01 to m30 with the pattern area rate and current density gradient Vn. Positive numbers not exceeding 1 are used as the values m01–m30 of the gradient correction factor mf. A small value is used as the gradient correction factor mf when the expected color density Df is likely to form a major overshooting in color density.

Instead of setting the gradient correction factor mf based on the current color density gradient Vn and the pattern area rate of a subject region, the gradient correction factor mf may be set based on either one of the current color density gradient Vn and the pattern area rate of a subject region.

Subsequently, the key opening degree variation coefficient kn derived from the foregoing equation (6) is corrected by using the gradient correction factor mf (step S59). Specifically, when kn is larger than 1 (i.e. when color density is on the increase), a corrected key opening degree variation coefficient kf is derived from equation (10) set out hereunder. When kn is smaller than 1 (i.e. when color density is on the decrease), a corrected key opening degree variation coefficient kf is derived from equation (11).

$$kf=(kn-1)\cdot mf+1 \quad (10)$$

$$kf=1-(1-kn)\cdot mf \quad (11)$$

In the above equations (10) and (11), the key opening degree variation coefficient kn is corrected by multiplying the key opening degree variation coefficient kn by the gradient correction factor mf. Instead, the key opening degree variation coefficient may be corrected by subtracting the gradient correction factor mf from the key opening degree variation coefficient kn.

Based on the corrected key opening degree variation coefficient kf, a new key opening degree KN is derived from the following equation (12), and the key opening degree of each ink key 2 is varied by operating the pulse motor 6 shown in FIG. 3 (step S60):

$$KN=kn\cdot K \quad (12)$$

When the forecast control is not performed, the key opening degree variation coefficient kn is used instead of the key opening degree variation coefficient kf as described above.

Subsequently, the number of prints in wait is set in order to prohibit variations in the opening degree of each ink key until stabilization of the ink feeding state following the key opening degree variation (i.e. setting as to how many sheets should be printed before permitting variations in the opening degree of each ink key) (step S61). This completes the automatic control operation as a subroutine.

With the printing machine according to this invention, as described above, the opening degree of each ink key 2 is adjusted by using the initial prediction control immediately after start of a printing operation, and using the forecast control in time of the automatic control after start of the printing operation. In this way, the color density of prints may be allowed to settle at a target value quickly.

In the foregoing embodiment, the invention is applied to the printing machine that performs a printing operation by recording images on blank printing plates mounted on the first and second plate cylinders 11 and 12, and transferring inks supplied to the printing plates through the first and second blanket cylinders 13 and 14 to printing paper held on the impression cylinder 15. However, this invention is applicable also to other, ordinary printing machines.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2002-145624 filed in the Japanese Patent Office on May 21, 2002, the entire disclosure of which is incorporated herein by reference.

What is claimed is:

1. An ink feeding method for a printing machine, for controlling an ink feeding rate by measuring color density of print, said method comprising:

a color density measuring step for measuring color density of prints at intervals of time;

a color density gradient computing step for computing, based on a plurality of color densities of prints measured in said color density measuring step, a color density gradient representing a rate of variation in the color density of prints occurring with an increase in the number of prints;

an expected color density computing step for computing, based on the color density gradient computed in said color density gradient computing step, an expected color density of prints occurring after a predetermined number of prints are made; and an ink feeding rate controlling step for controlling the ink feeding rate based on a difference or ratio between a current color density of prints and a target color density of prints; and if the target coloring density is determined to exist between the current color density and expected color density, a variation of ink feeding rate in said ink feeding rate controlling step is reduced.

2. An ink feeding method as defined in claim 1, wherein said ink feeding rate controlling step is executed for controlling the ink feeding rate based on a difference between said expected color density of prints and said target color density of prints.

3. An ink feeding method as defined in claim 1, wherein said ink feeding rate controlling step is executed for controlling the ink feeding rate based on a ratio between said expected color density of prints and said target color density of prints.

4. An ink feeding method as defined in claim 1, wherein said color density measuring step is executed for measuring the color density of prints at intervals of time by an image pickup unit arranged to pick up images of printed sheets of paper transported toward a paper discharge position.

5. An ink feeding method for a printing machine, for controlling an ink feeding rate by measuring color density of prints, said method comprising:

a color density measuring step for measuring color density of prints at intervals of time;

a variation coefficient computing step for computing a variation coefficient for varying the ink feeding rate, based on the color density of prints measured in said color density measuring step and a target color density of prints;

a color density gradient computing step for computing, based on the color densities of prints measured in said color density measuring step, a color density gradient representing a rate of variation in the color density of prints occurring with an increase in the number of prints;

an expected color density computing step for computing, based on the color density gradient computed in said color density gradient computing step, an expected color density of prints occurring after a predetermined number of prints are made;

a determining step for determining, based on the expected color density of prints computed in said expected color density computing step, a current color density measured in said color density measuring step and the target color density of prints, whether the target color density exists between the current color density and expected color density;

a variation coefficient correcting step for correcting the variation coefficient computed in said variation coefficient computing step to the corrected variation coefficient, if the target color density is determined in said determining step to exist between the current color density and expected color density; and an ink feeding rate controlling step for controlling the ink feeding rate based on one of the variation coefficient computed in said variation coefficient computing step and the corrected variation coefficient corrected in said variation coefficient correcting step.

6. An ink feeding method as defined in claim 5, wherein said variation coefficient correcting step is executed for correcting the variation coefficient computed in said variation coefficient computing step based on a value of at least one of the color density gradient computed in said color density gradient computing step and a pattern area rate of the prints.

7. An ink feeding method as defined in claim 5, wherein said color density measuring step is executed for measuring the color density of prints at intervals of time by an image pickup unit arranged to pick up images of printed sheets of paper transported toward a paper discharge position.

8. An ink feeding method as defined in claim 5, wherein said variation coefficient computing step is executed for computing the variation coefficient based on a difference between the color density of prints measured in said color density measuring step and the target color density of prints.

9. An ink feeding method as defined in claim 8, wherein said variation coefficient computing step is executed for computing the variation coefficient by using a pattern area rate of the prints.

10. An ink feeding method for a printing machine, for controlling an ink feeding rate at an initial printing stage by measuring color density of prints, said method comprising:

a color density measuring step for measuring color density of prints at intervals of time after printing a fixed number of printing sheets without varying the ink feeding rate after start of a printing operation;

a color density gradient computing step for computing, based on the color density of prints measured in said color density measuring step, a color density gradient representing a rate of variation in the color density of prints occurring with an increase in the number of prints;

an expected color density computing step for computing, based on the color density gradient computed in said color density gradient computing step, an expected color density of prints occurring after a predetermined number of prints are made; and an ink feeding rate controlling step for controlling the ink feeding rate based on the expected color density of prints computed in said expected color density computing step and a target color density of prints.

11. An ink feeding apparatus for a printing machine, for controlling an ink feeding rate by measuring color density of prints, said apparatus comprising:

color density measuring means for measuring color density of prints at intervals of time;

color density gradient computing means for computing, based on the color density of prints measured by said color density measuring means, a color density gradient representing a rate of variation in the color density of prints occurring with an increase in the number of prints;

expected color density computing means for computing, based on the color density gradient computed by said color density gradient computing means, an expected color density of prints occurring after a predetermined number of prints are made; and ink feeding rate control means for controlling the ink feeding rate based on the expected color density of prints computed by said expected color density computing means and a target color density of prints.

12. An ink feeding apparatus as defined in claim 11, wherein said ink feeding rate control means is arranged to control the ink feeding rate based on a difference between said expected color density of prints and said target color density of prints.

13. An ink feeding apparatus as defined in claim 11, wherein said ink feeding rate control means is arranged to control the ink feeding rate based on a ratio between said expected color density of prints and said target color density of prints.

14. An ink feeding apparatus as defined in claim 11, wherein said color density measuring means includes an image pickup unit for picking up images of printed sheets of paper transported toward a paper discharge position.

15. An ink feeding apparatus for a printing machine, for controlling an ink feeding rate by measuring color density of prints, said apparatus comprising:

color density measuring means for measuring color density of prints at intervals of time;

variation coefficient computing means for computing a variation coefficient for varying the ink feeding rate, based on the color density of prints measured by said color density measuring means and a target color density of prints;

color density gradient computing means for computing, based on the color density of prints measured by said color density measuring means, a color density gradient representing a rate of variation in the color density of prints occurring with an increase in the number of prints;

expected color density computing means for computing, based on the color density gradient computed in said color density gradient computing means, an expected color density of prints occurring after a predetermined number of prints are made;

determining means for determining, based on the expected color density of prints computed by said expected color density computing means and the target color density of prints, whether the expected color density of prints are made exceeds the target color density of prints;

variation coefficient correcting means for correcting the variation coefficient computed by said variation coefficient computing means when the expected color density of prints is determined by said determining means to exceed the target color density of prints; and ink feeding rate control means for controlling the ink feeding rate based on one of the variation coefficient computed by said variation coefficient computing means and the variation coefficient corrected by said variation coefficient correcting means.

16. An ink feeding apparatus as defined in claim 15, wherein said variation coefficient correcting means is arranged to correct the variation coefficient computed by said variation coefficient computing means based on a value of at least one of the color density gradient computed by said color density gradient computing means and a pattern area rate of the prints.

17. An ink feeding apparatus as defined in claim 15, wherein said color density measuring means includes an image pickup unit for picking up images of printed sheets of paper transported toward a paper discharge position.

18. An ink feeding apparatus as defined in claim 15, wherein said variation coefficient computing means is arranged to compute the variation coefficient based on a difference between the color density of prints measured by said color density measuring means and the target color density of prints.

19. An ink feeding apparatus as defined in claim 18, wherein said variation coefficient computing means is arranged to compute the variation coefficient by using a pattern area rate of the prints.

20. An ink feeding apparatus for a printing machine, for controlling an ink feeding rate at an initial printing stage by measuring color density of prints, said apparatus comprising:

color density measuring means for measuring color density of prints at intervals of time after printing a fixed number of printing sheets without varying the ink feeding rate after start of a printing operation;

color density gradient computing means for computing, based on the color density of prints measured by said color density measuring means, a color density gradient representing a rate of variation in the color density of prints occurring with an increase in the number of prints;

expected color density computing means for computing, based on the color density gradient computed by said color density gradient computing means, an expected color density of prints occurring after a predetermined number of prints are made; and ink feeding rate control means for controlling the ink feeding rate based on the expected color density of prints computed by said expected color density computing means and a target color density of prints.

* * * * *